US006633094B1

(12) United States Patent
Andou

(10) Patent No.: US 6,633,094 B1
(45) Date of Patent: Oct. 14, 2003

(54) SPEED REGULATOR FOR AUTOMATICALLY CLOSING SLIDE DOOR

(75) Inventor: Kazuaki Andou, Amagasaki (JP)

(73) Assignee: Howa Corporation, Hyogo (JP)

( * ) Notice: Subject to any disclaimer, the term of this patent is extended or adjusted under 35 U.S.C. 154(b) by 0 days.

(21) Appl. No.: 09/684,980

(22) Filed: Oct. 10, 2000

Related U.S. Application Data

(63) Continuation of application No. PCT/JP00/00151, filed on Jan. 14, 2000.

(30) Foreign Application Priority Data

Feb. 10, 1999 (JP) ..... 11-072484
Apr. 27, 1999 (JP) ..... 11-120546
Aug. 30, 1999 (JP) ..... 11-243061

(51) Int. Cl.[7] ..... E05F 3/00

(52) U.S. Cl. ..... 307/326; 318/282; 49/228

(58) Field of Search ..... 307/326; 318/282, 318/434, 466, 468; 49/228, 231; 16/49, 64

(56) References Cited

U.S. PATENT DOCUMENTS

| | | | | | |
|---|---|---|---|---|---|
| 3,043,584 | A | * | 7/1962 | Kielhorn | 49/138 |
| 3,621,349 | A | * | 11/1971 | Reyx | 318/138 |
| 3,834,081 | A | * | 9/1974 | Catlett | 49/118 |
| 3,918,201 | A | * | 11/1975 | Graziano | 49/139 |
| 4,092,575 | A | * | 5/1978 | Ogishi et al. | 318/282 |
| 4,104,826 | A | * | 8/1978 | Wadford | 49/360 |
| 4,145,641 | A | * | 3/1979 | Ozaki | 318/266 |
| 4,333,270 | A | * | 6/1982 | Catlett | 49/336 |
| 4,479,285 | A | * | 10/1984 | Ragan | 19/64.5 |
| 4,646,471 | A | * | 3/1987 | Shaiu | 49/229 |

(List continued on next page.)

FOREIGN PATENT DOCUMENTS

| | | | | |
|---|---|---|---|---|
| DE | 19547683 A1 | * | 6/1997 | E05F/3/00 |
| EP | 0298514 A1 | * | 11/1989 | E05F/3/16 |
| JP | 01-190888 | | 7/1989 | |
| JP | 05-272271 | * | 10/1993 | E05F/1/02 |
| JP | 05278976 | * | 10/1993 | B66B/13/08 |
| JP | 07-189549 | * | 7/1995 | E05F/3/02 |
| JP | 08-218727 | * | 8/1996 | E05F/5/02 |
| JP | 08-246744 | * | 9/1996 | E05F/5/02 |
| JP | 08-326409 | * | 12/1996 | E05F/5/02 |
| JP | 09021271 A | * | 1/1997 | E05F/3/18 |
| JP | 09-88415 | * | 3/1997 | E05F/5/02 |
| JP | 09-242415 | * | 9/1997 | E05F/5/02 |
| JP | 10-37569 | * | 2/1998 | E05F/1/04 |
| JP | 10-37584 | * | 2/1998 | E05F/3/02 |
| JP | 11-200706 | * | 7/1999 | E05F/15/14 |
| JP | 2000-204840 | * | 7/2000 | E05F/1/04 |
| JP | 2001-132316 | * | 5/2001 | E05F/5/00 |
| JP | 2002-4701 | * | 1/2002 | E05F/5/02 |
| JP | 2002-13345 | * | 1/2002 | E05F/3/00 |

OTHER PUBLICATIONS

International Search Report for PCT/JP00/00151 Apr. 18, 2000.

*Primary Examiner*—Brian Sircus
*Assistant Examiner*—Roberto J. Rios
(74) *Attorney, Agent, or Firm*—Nixon Peabody LLP; Donald R. Studebaker

(57) ABSTRACT

Disclosed is a speed regulator for an automatically closing slide door for regulating a closing speed of an automatically closing slide door which is closed automatically, comprising; a generator associated with said slide door; an one-way clutch means for converting a linear movement caused during a closing motion of said slide door into a rotational movement and for transmitting said rotational movement to said generator; a resistor connected to an output of said generator; and a speed change means for changing said closing speed of said slide door, at a predetermined position before the closed position of said slide door, from a first predetermined speed to a second predetermined speed slower than said first predetermined speed by changing a resistance value of said resistor.

10 Claims, 11 Drawing Sheets

U.S. PATENT DOCUMENTS 4,823,509 A * 4/1989 Ando ..... 49/303
4,847,541 A * 7/1989 Krieger ..... 318/468
4,909,093 A * 3/1990 Mudford ..... 476/65
4,941,320 A * 7/1990 Kersten et al. ..... 49/360
4,973,894 A * 11/1990 Johansson ..... 318/280
5,046,377 A * 9/1991 Wilkes et al. ..... 74/431
5,134,324 A * 7/1992 Sakagami et al. ..... 318/135
5,193,647 A * 3/1993 O'Brien ..... 16/49
5,218,282 A * 6/1993 Duhame ..... 318/434
5,278,480 A * 1/1994 Murray ..... 318/266
5,347,755 A * 9/1994 Jaster et al.
5,594,316 A * 1/1997 Hayashida ..... 320/108
5,606,826 A * 3/1997 Calhoun ..... 49/138
5,625,266 A * 4/1997 Stark ..... 318/466
5,656,898 A * 8/1997 Kalina ..... 318/282
5,701,973 A * 12/1997 Tracey ..... 187/316
5,712,546 A * 1/1998 Holthouse et al. ..... 318/282
5,797,471 A * 8/1998 Princell ..... 187/324
5,831,403 A * 11/1998 Kanki et al. ..... 318/286
5,850,865 A * 12/1998 Hsieh ..... 160/310
5,857,290 A * 1/1999 Schnarr ..... 16/102
5,955,852 A * 9/1999 Jentsch ..... 318/282
5,970,657 A * 10/1999 Glass ..... 49/228
5,979,114 A * 11/1999 Clark et al. ..... 49/360
6,108,975 A * 8/2000 Bailey ..... 49/334
6,108,976 A * 8/2000 Kato et al. ..... 49/352
6,177,771 B1 * 1/2001 Kinzer et al. ..... 318/466
6,208,102 B1 * 3/2001 Kikuchi et al. ..... 318/282
6,225,904 B1 * 5/2001 Jaffe et al. ..... 340/545.6
2002/0088180 A1 * 7/2002 Yokomori ..... 49/31
2002/0153744 A1 * 10/2002 Long et al. ..... 296/155

* cited by examiner

SPEED REGULATOR FOR AUTOMATICALLY CLOSING SLIDE DOOR

This application is a continuation of International Application No. PCT/JP00/00151 filed Jan. 14, 2000.

TECHNICAL FIELD

The present invention relates to a speed regulator for reducing a closing speed of an automatically closing slide door configured to automatically close from an opened position to a closed position.

BACKGROUND ART

Conventionally, an automatically closing slide door is known which is configured to automatically close from an opened position to a closed position. Such a door is automatically closed in many ways. For example, the opened door is closed by a thrust force exerted by an elastic member or is pulled in the closing direction by a weight or the like, or the door is suspended via a door roller from a rail inclining downward from the opened position to the closed position so that the slide door travels due to the self weight in the direction of closing the slide door.

Since the closing speed of such automatically closing slide door, if uncontrolled, gradually increases because of the acceleration by the thrust force exerted by the elastic member, by the descending weight, or by the weight of the slide door itself, there could occur a trouble that the door bumps a doorframe or the like at its highest speed when the door reaches the closed position. Despite of the trouble, such automatically closing slide door is often used, for example, at hospitals, homes for the aged or the like. Since sick people, those using wheelchairs or old people at the homes for the aged can not act as quickly as ordinarily healthy or young people, they sometimes fail in passing the automatically closing slide door while it is open. Further, especially in an automatically closing slide door configured to close by the weight or by its self weight, the automatically closing slide door reaches its highest speed just before the closed position due to the acceleration. Therefore, a noise is likely to occur when the door closes and a finger may possibly be clamped (hereinafter referred to as "finger clamping").

To solve these problems, for example, the Japanese Utility Model Laid-Open Disclosure No. H1-22070 discloses an automatically closing slide door which is provided with a shock absorber for reducing the impact caused by the door when closed so as to close the door quietly. Further, the Japanese Utility Model Laid-Open Disclosure No. H5-42564 discloses a device for preventing the finger clamping at the moment when the door closes. The device has a pinion gear mounted on a slide door and a rack mounted on a rail of the slide door and they are configured to be engaged and disengaged with each other so as to provide a speed reduction zone where the rotating speed of the pinion gear is reduced by a rotary oil damper coupled to a main rotatable shaft of the pinion gear.

Further, the Japanese Patent Laid-Open Disclosure No. H1-190888 discloses a device which closes a slide door using a spring force from a tightly-wound spiral spring. To apply brakes to the closing door, a DC-motor is employed as a generator which is utilized to work as a speed regulator. This allows the slide door to travel almost at a constant speed in the closing direction from the opened position to the closed position. Further, in this case, the speed of the closing door can be regulated on the site by adjusting the resistance value of a resistor which is connected between the input terminals of the DC motor so as to make a short-circuit there between, if necessary. Further, the Japanese Patent Laid-Open Disclosure No. H8-93316 discloses, for example, a bake device for a slide door or the like, which is configured to close a slide door by utilizing a potential energy to be supplied while the slide door is traveling along a rail provided with a small difference in the height between an opened position and a closed position. This brake device has a rack-and-pinion mechanism installed between a slide door and a doorframe for mounting the slide door and a generator for generating electric power by utilizing the closing action of the slide door, and brakes the closing slide door by utilizing an attracting force working between an electromagnetic force produced at a generator coil and a permanent magnet arranged around the generator coil.

Further, a speed reducer disclosed in the Japanese Patent Laid-open Disclosure No. H2-20784 operates speed regulating means for braking an automatically closing slide door during the slide door closing in such a way that a speed increasing gear train with a low speed increasing ratio is coupled to the speed regulating means for the initial stage of the door closing so as to produce a small braking force which allows the slide door to be closed at a relatively high speed, while another speed increasing gear train with a high speed increasing ratio is coupled to the speed regulating means so as to produce a large braking force which allows the slide door to be closed at a relatively low speed for the final stage of the door closing.

Although the way described above which reduces the impact at the moment of door closing by using a shock absorber or the like can control the door speed just before the final closing of the door, the closing speed of the slide door gradually increases during the period from the start of door closing until the shock absorber or the like begins to operate, which may sometimes give fear to a person passing the door, especially to an aged person. Further, those using wheelchairs or walking on crutches may suffer from such a trouble that the slide door bumps them because they cannot stop the door while they are passing the door.

Further, since a speed regulator employing the generator described above travels at a constant speed from the opened position to the closed position, the regulator cannot solve such problems as the finger clamping and the noise.

Further, when the slide door travels at a relatively high speed during the initial stage of the door closing and travels at a relatively slow speed during the final stage of the door closing, such traveling speed may be suitable under some conditions but may be unsuitable under other conditions.

Therefore, the object of the present invention is to provide a speed regulator for an automatically closing slide door which can reduce the closing speed of the slide door to the most suitable one for a person passing the slide door without causing problems such as the bump against the slide door, the finger clamping and the closing noise.

DISCLOSURE OF INVENTION

The object of the present invention can be achieved by a speed regulator for regulating a closing speed of an automatically closing slide door, comprising; a generator associated with said slide door; one-way clutch means for converting a linear movement of said slide door while closing into a rotational movement and for transmitting said rotational movement to said generator; a resistor connected to an output of said generator; and speed change means for changing a closing speed of said slide door, at a predetermined position before a closed position of said slide door, from a first predetermined speed to a second predetermined speed which is slower than said first predetermined speed by changing a resistance value of said resistor.

In the speed regulator for an automatically closing slide door according to the present embodiment, the movement of the slide door is not transmitted to the generator due to the one-way clutch means when a slide door is being opened. On the other hand, when the slide door starts to travel in the closing direction, the one-way clutch means converts the linear movement of the slide door into the rotational movement by which the generator is rotation ally driven. The mechanism for producing electric power in the generator is constructed such that a coil is rotated in a magnetic field to generate a voltage in the coil so as to produce a current. This mechanism is also applied to the present invention, wherein a rotary shaft is rotated in a magnetic field to produce electric power, the generated voltage gets higher with the increase in the revolution speed and a braking force substantially acts on the rotatable shaft of the generator when a large power is consumed. This braking force is transmitted to the one-way clutch means and is then applied to the linear movement of the slide door, and whereby the closing speed of the automatically closing slide door is reduced to the first predetermined speed.

After traveling at the first predetermined speed over a certain distance toward the closed position, the slide door reaches the predetermined position located before the closed position thereof, where the resistance value of the resistor applied to the output of the generator is reduced by the speed change means. This causes more current to flow and consequently a larger load is applied to the generator to increase the braking force and whereby the closing speed of the slide door is further decelerated to the second predetermined speed which is lower than the first predetermined speed, and travels to the closed position at this low speed The automatically closing slide door used in the present invention may be any type of automatically closing slide door whose closing speed is controlled, including a slide door which closes at a substantially low speed using a thrust force exerted by an elastic member or a motor, not limited to such slide door which is pulled in the closing direction by the weight or the like, or which is accelerated by its own weight on an inclining rail while being closed. The resistor may be either of a fixed resistor with a predetermined resistance value or a variable resistor with a variable resistance value. Further, in order to reduce the speed between the predetermined position and the closed position, one variable resistor may be provided so that the resistance value thereof is changed by speed change means, or two resistors, each having different resistance values may be provided so that the resistors are switched to each other by the speed change means. Further, the closing speed may be reduced in two stages from the first predetermined speed to the second predetermined speed at the predetermined point before the closed point, or may be reduced in multi-stages more than two stages, or also may be reduced gradually while the slide door is traveling from the predetermined position before the closed position to the closed position. Further, the generator may be mounted either on the slide door or on a stationary frame attached to a building.

According to the present invention, the closing speed of the automatically closing slide door is decelerated to a desired speed and then, closed completely. Therefore, no problem takes place such as that the slide door gives fear to a person passing the slide door or the slide door bumps to the person. Further, since the closing speed of the slide door is further reduced at the predetermined point before the closed position of the slide door, such problems as the finger clamping and the closing noise can be prevented. Further, since the present invention uses the generator and the resistor connected to the output of said generator for reducing the speed of the slide door, neither the power supply nor the wiring is necessary, and the speed regulator can easily be installed in an existing slide door even if there is no power supply near by.

BEST MODE FOR CARRYING OUT THE INVENTION

Referring to the attached drawings, embodiments of a speed regulator for an automatically closing slide door according to the present invention will be described in details.

Figure 1:
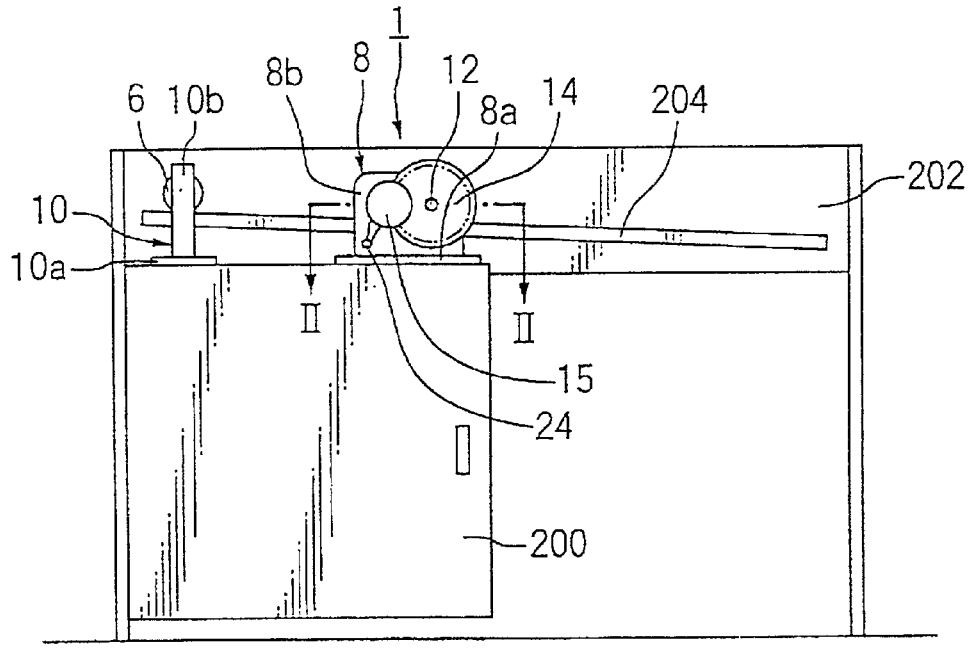
FIG. 1 shows an overall configuration of an automatically closing slide door provided with a speed regulator according to a first embodiment of the present invention, illustrating the slide door at the opened position.
Figure 2:
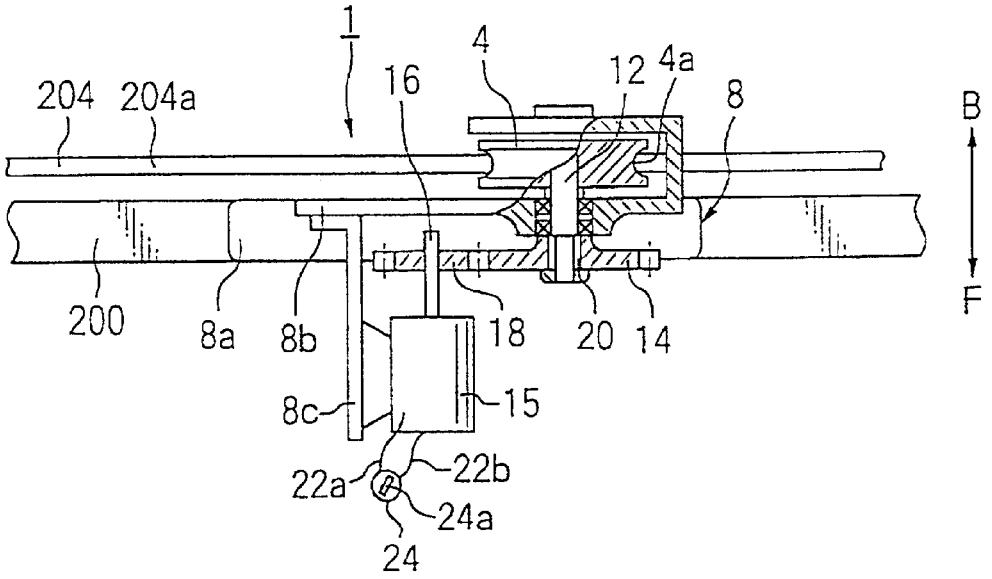
FIG. 2 is a cross-sectional view taken along a line ll—ll of FIG. 1, illustrating the speed regulator according to the first embodiment of the present invention.

FIG. 1 shows an overall configuration of an automatically closing slide door provided with a speed regulator according to a first embodiment and illustrates the slide door at an opened position. FIG. 2 is a cross-sectional view taken along a line II—II of FIG. 1 of the speed regulator according to the first embodiment.

A slide door 200 according to a first embodiment shown in FIG. 1 is located within a doorframe 202. The doorframe 202 is provided with a rail 204 inclining downward from an opened position (shown in FIG. 1) to a closed position. Door rollers 4, 6 are attached via holding fixtures or mounting brackets 8, 10 to the slide door 200 at an upper portion thereof. The slide door 200 is suspended from a rail 204 by placing the rollers 4, 6 thereon. Each of the mounting brackets 8, 10 is formed into an L-shaped section. As shown in FIGS. 1 and 2, it has a horizontal plate 8*a*, 10*a* to be attached to the top surface of the slide door 200 and a vertical plate portions 8*b*, 10*b* which extend straight in a vertical and upward direction so as to be flush with a back surface of the slide door (the back surface in FIG. 1, i.e., the side "B" indicated by an arrow in FIG. 2).

In the present embodiment, as shown in FIG. 1, a speed regulator 1 for the automatically closing slide door is mounted only on one of the door rollers indicated at 4. Referring to FIG. 2, a door roller shaft 12 of the door roller 4 is mounted on the vertical plate portion 8*b* via a bearing. It has a rear end portion located on the back side (the "B" side indicated by the arrow) with respect to the vertical plate portion 8*b* and a front-end portion located on a front side (the "F" side indicated by an arrow) with respect to the vertical plate portion 8*b*. The door roller 4 is mounted on the rear end portion of the door roller shaft 12. Further, a large diameter gear 14 is mounted on the front-end portion of the door roller shaft 12 via a one-way bearing 20. Further, an extension plate portion 8*c* extends in a forward direction and forms a right angle with respect to the vertical plate portion 8*b*. A generator 15 is mounted on the extension plate portion 8*c*. A rotatable shaft 16 of the generator 15 extends parallel with the door roller shaft 12 toward the vertical plate portion 8*b*. A small diameter gear 18 whose number of teeth is less than that of the large diameter gear 14 is mounted on a front-end portion of the rotatable shaft 16. The small diameter gear 18 and the large diameter gear 14 mesh with each other and whereby means for transmitting mechanical movement (hereinafter referred to as the "mechanical movement transmission means") or speed increasing means is constructed. Further, these small and large diameter gears 18, 14 and the one-way bearing 20*a* compose one-way clutch means. The one-way bearing 20 works in such a way that the rotation of the door roller shaft 12 caused by that of the door roller 4 which travels along the rail 204 is not transmitted to the large diameter gear 14 while the slide door 200 travels from the closed position to the opened position. On the contrary, the rotation of door roller shaft 12 is transmitted to the large diameter gear 14 while the slide door 200 travels from the opened position to the closed position. That is, the rotation of the door roller shaft 12 is transmitted to the rotatable shaft 16 of the generator 15 only when the slide door 200 is closing. Further, a variable resistor 24 is connected to output electric wires 22*a*, 22*b* of the generator 15.

A groove-shaped engaging portion 4*a* is formed on a circumference surface of the door roller 4. The groove-shaped engaging portion 4*a* is placed on a guide surface 204*a* of the rail 204 and the slide door 200 is supported thereby so as to be spaced from the rail 204.

All the components of the speed regulator 1 described hereinabove are mounted on the mounting bracket 8 to be combined into one unit so that they can be integrally mounted on the top surface of the slide door 200. Further, if an existing slide door has a door roller mounted thereon, the speed regulator can be mounted by merely removing the existing door roller and the mounting bracket thereof and by attaching the mounting bracket 8 of the speed regulator 1 to the slide door 200.

Further, as shown in FIG. 1, the total height of the speed regulator 1 is substantially equal to the height of the door roller 6, i.e. the typical height of a door roller for a suspension-type slide door. Further, as can be seen in FIG. 2, the speed regulator 1 does not protrude from the rail 204 in a backward direction toward the doorframe 202 so much. Therefore, when the speed regulator 1 is mounted on an existing slide door, it can be accommodated within a space in the vicinity of the existing rail.

Figure 3:
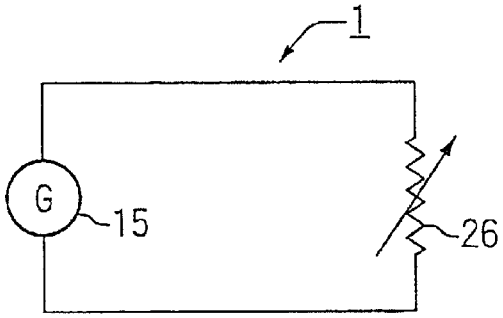
FIG. 3 is a circuit diagram of the speed regulator according to the first embodiment of the present invention.

FIG. 3 is a circuit diagram of the speed regulator according to the first embodiment.

As shown in FIG. 3, the speed regulator 1 according to the first embodiment has a generator 15 and a variable resistor 26 which is connected to the output of the generator 15.

The speed regulator 1 operates in the following way. First, a regulating dial 24*a* of a rheostat 24 is turned to change the resistance value of the variable resistor 26 and whereby a closing speed of the slide door 200 is adjusted to a desired speed. A smaller resistance value of the variable resistor 26 results in a slower closing speed, while a larger resistance value of the variable resistor 26 results in a faster closing speed.

Then, the slide door 200 is opened by hand to the opened position shown in FIG. 1. During this opening process, though the door roller 4 rotates, the one-way bearing 20 prevents the rotation of the door roller shaft 12 which would be transmitted to the rotatable shaft 16 of the generator 15 via the large diameter gear 14 and small diameter gear 18. Therefore, the generator is not driven thereby. Then, when the hand is withdrawn from the slide door so as to let it go, the slide door 200 starts to travel along the rail 204 due to its own weight toward the closed position. It causes the door roller 4 to be rotated and the rotational speed of the door roller shaft 12 is increased through the large diameter gear 14 and the small diameter gear 18. Then, it is transmitted to the rotatable shaft 16 of the generator 15, and whereby the generator 15 is driven. The rotation of the rotatable shaft 16 of the generator 15 in a magnetic field produces a current in an armature and the voltage is increased due to the variable resistor 26. A load is applied to the generator 15 thereby and a braking force against the rotatable shaft 16 is produced. Then, this braking force is transmitted to the small diameter gear 18, the large diameter gear 14, and further to the door roller shaft 12 to brake against the rotation of the door roller 4. The slide door 200 tends to make an accelerated travel along the inclining rail 204. However, the rotation of the door roller 4 is subjected to this braking force, and whereby the closing speed of the slide door 200 is reduced.

Figure 4:
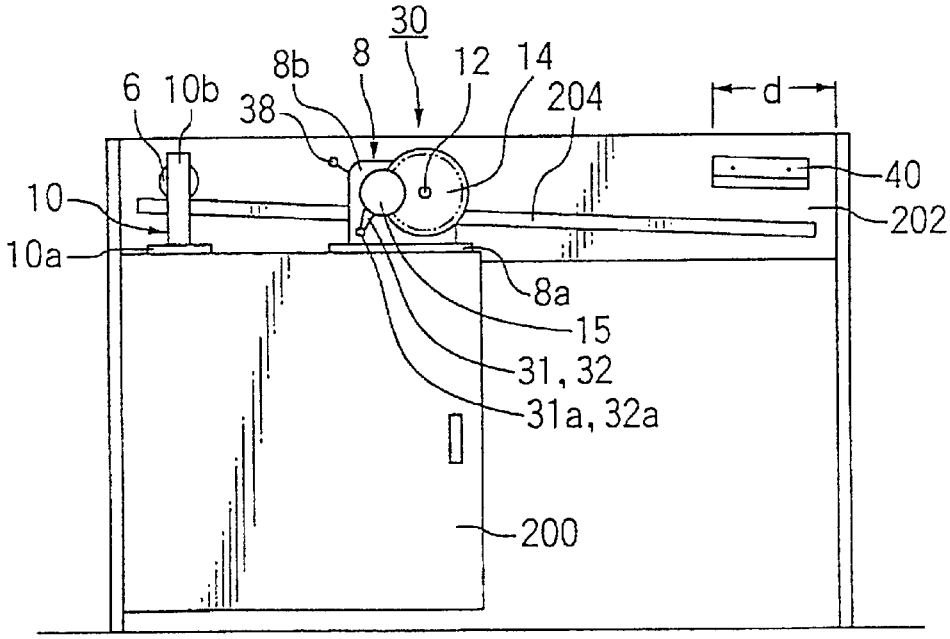
FIG. 4 shows an overall configuration of an automatically closing slide door provided with a speed regulator according to a second embodiment of the present invention.

FIG. 4 shows an overall configuration of an automatically closing slide door provided with a speed regulator according to a second embodiment. Further, FIG. 5 is a circuit diagram of the speed regulator according to the second embodiment.

Figure 5:
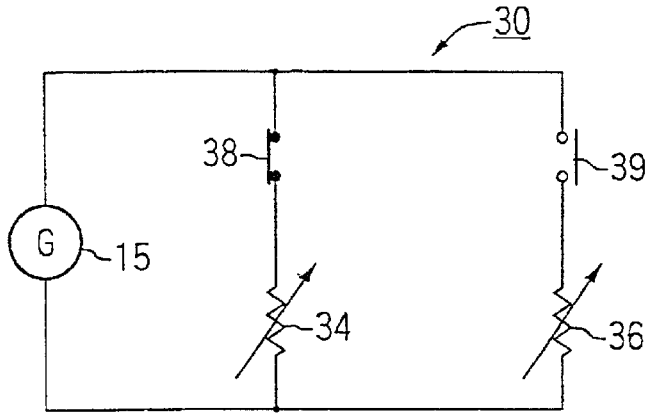
FIG. 5 is a schematic circuit diagram with main components of the speed regulator according to the second embodiment of the present invention.

The second embodiment shown in FIGS. 4 and 5 is configure in a similar manner as the first embodiment except that the slide door 200 travels from the opened position to the closed position at a first closing speed and a second closing speed which is decelerated when it passes a point "d" located slightly before the closed position. Accordingly, the same elements are indicated at the same reference numerals in FIGS. 4 and 5 and no detailed description shall be made therefore. Only the different points shall be described herein below.

The speed regulator 30 for an automatically closing slide door according to the second embodiment has a rheostat 31 with a first variable resistor 34 (see FIG. 5), a rheostat 32 with a second variable resistor 36 (see FIG. 5), a switch 38 for switching between the first variable resistor 34 and the second variable resistor 36, and a switching member 40 mounted in a doorframe 202. The switching member 40 is mounted at a point which is located a predetermined distance "d" apart from the closed position of the slide door 200. Switching means-has a switch 38 and a switching member 40.

A circuit according to the second embodiment will be described with the reference to FIG. 5. The speed regulator 30 has the generator 15, the first variable resistor 34 connected to the output of the generator 15, the second variable resistor 36 connected in parallel with the first variable resistor 34, and switches 38 and 39 for switching between the first variable resistor 34 and the second variable resistor 36. In a normal condition, a current flows through the switch 38 to the first variable resistor 34.

As for the operation of the speed regulator 30 according to the second embodiment, at first, each of regulating dials 31*a* and 32*a* of the rheostats 31 and 32 is turned so that each of the resistance values thereof is regulated so that each of the first and second traveling speeds is set to desired values. The second resistance value of the second variable resistor 36 is set to a smaller one compared to the first resistance value of the first variable resistor 34 so that the second traveling speed is slower than the first traveling speed. At an initial position, the switch 38 makes a closed circuit for the first variable resistor 34. When the slide door is opened by hand and then, is released, the slide door 200 starts to travel from the opened position to the closed position at the first closing speed which is reduced by the first resistor 34, as in the first embodiment. When the slide door 200 reaches the point which is located the distance "d" apart from the closed position, the switch 38 is turned off and the switch 39 is turned on by the switching member 40 so that the first variable resistor 34 is made ineffective and in turn the second variable resistor 34 becomes effective. Thus, the generator 15 is required to supply more current, and whereby a braking force is applied to the rotation of the rotatable shaft 16 and to the rotation of the door roller 4 via the small diameter gear 18 and the large diameter gear 14. As a result, the slide door 200 is decelerated to the second closing speed which is slower than the first closing speed and it travels to the closed position.

Figure 6:
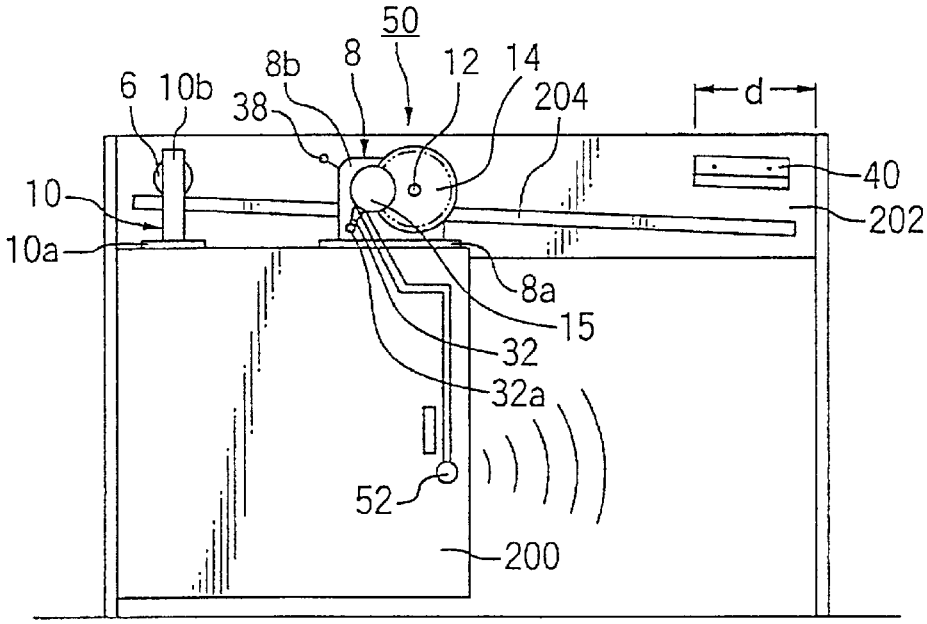
FIG. 6 shows an overall configuration of an automatically closing slide door provided with a speed regulator therefore according to a third embodiment of the present invention.

FIG. 6 shows an overall configuration of an automatically closing slide door 200 provided with a speed regulator 50 according to a third embodiment. Further, FIG. 7 is a circuit diagram of the speed regulator 50 according to the third embodiment.

Figure 7:
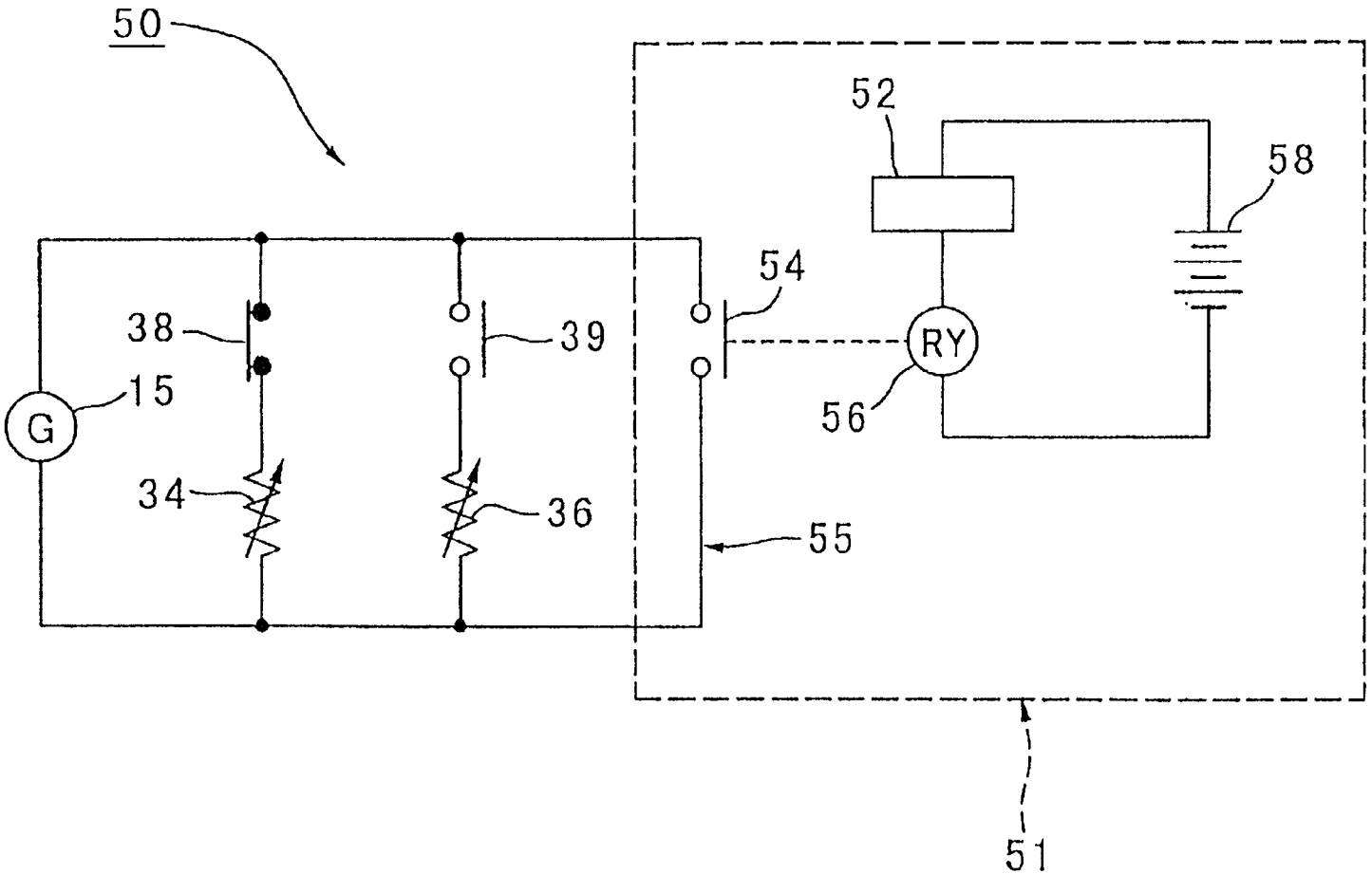
FIG. 7 is a circuit diagram of the main speed regulator according to the third embodiment of the present invention.

The third embodiment shown in FIGS. 6 and 7 is similarly configured as the second embodiment, except that a sensor circuit 51 for decelerating the slide door 200 and for making the slide door almost stopped is provided for such a case where a person, a wheelchair, or the like is detected while the slide door 200 is traveling from the opened position to the closed position. Therefore, regarding the same elements are indicated at the same reference numerals in FIGS. 4 and 5 and no detailed description shall be made therefore and only the differences shall be described herein below.

The sensor circuit 51 has a non-contact type sensor 52 mounted on the slide door 200 at an edge portion thereof which oriented toward a passage. Referring to a circuit diagram shown in FIG. 7, the sensor circuit 51 includes a short circuit 55 connected in parallel with the variable resistors 34 and 36 in addition to the circuit in accordance with the second embodiment shown in FIG. 5. The short circuit 55 has a relay contact point 25 54 which is normal-off. Further, a sensor 52 and a relay 56 for closing the relay contact point 54 are connected to a battery 58 in series.

The third embodiment works in such a way that the relay 56 operates so that the relay contact point 54 is turned on to make the short circuit 55 completed when the sensor 52 detects a person, a wheelchair or the like which is coming near the slide door 200 while the slide door 200 is traveling from the opened position to the closed position. This sharply decreases the resistance value, maximizes the load to the generator 15, and produces the maximum braking force. Then, the closing speed of the slide door 200 is sharply reduced and the door roller rotates very slowly. The slide door is nearly stopped thereby. When the person or the like moves outside a sensor detecting area, the relay 56 causes the relay contact point 54 to turn off again and the short circuit 55 is automatically disconnected. Then, the slide door 200 again starts to travel at its original first closing speed. When the door comes near the closed position, it is decelerated to the second closing speed due to respective "off" and "on" operations of the switch 38 and 39 located in the vicinity of the closed position. Whenever the sensor 52 detects a person or the like, the operation described above repeatedly takes place. The sensor 52 operates also while the slide door is traveling at the second predetermined speed.

Figure 8:
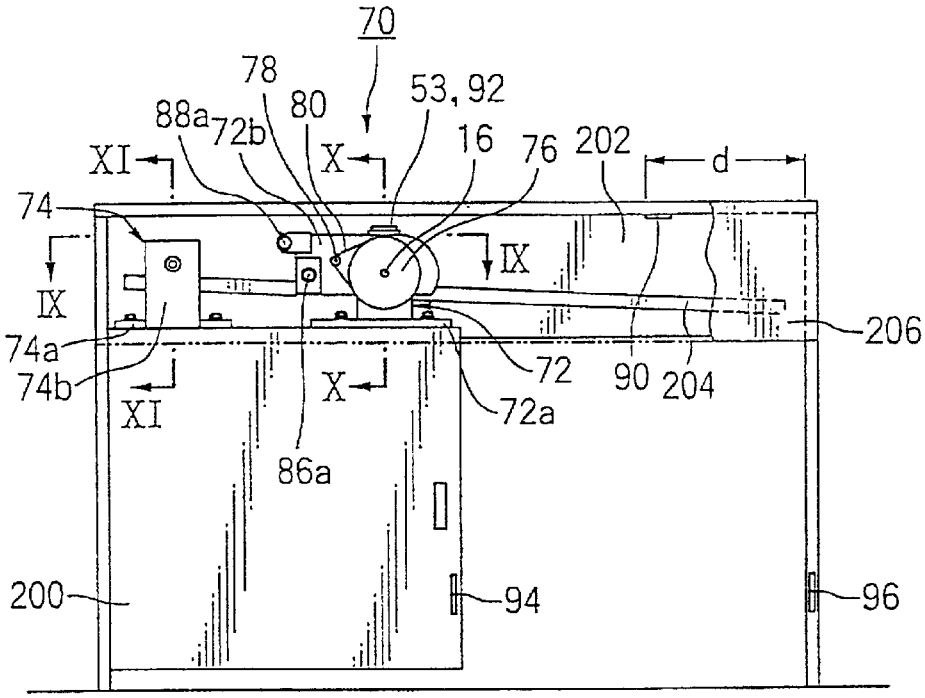
FIG. 8 shows an automatically closing slide door provided with a speed regulator according to a fourth embodiment of the present invention, illustrating the slide door at the opened position.

FIG. 8 shows an automatically closing slide door provided with a speed regulator according to a fourth embodiment, with the slide door at the opened position. Further, FIG. 9 is a view taken along a line IX—IX of FIG. 8, FIG. 10 is a cross-sectional view taken along a line X—X of FIG. 8, and FIG. 11 is a cross-sectional view taken along a line XII—XII of FIG. 8.

A speed regulator 70 and a slide door 200 according to the fourth embodiment shown in FIGS. 8 to 11 are similarly constructed In terms of functions as the third embodiment shown in FIG. 6, but are different in terms of mechanical arrangements. Similar reference numerals shall be used for the same components and no detailed description therefore shall be made. Only the differences shall be described herein below.

Figure 9:
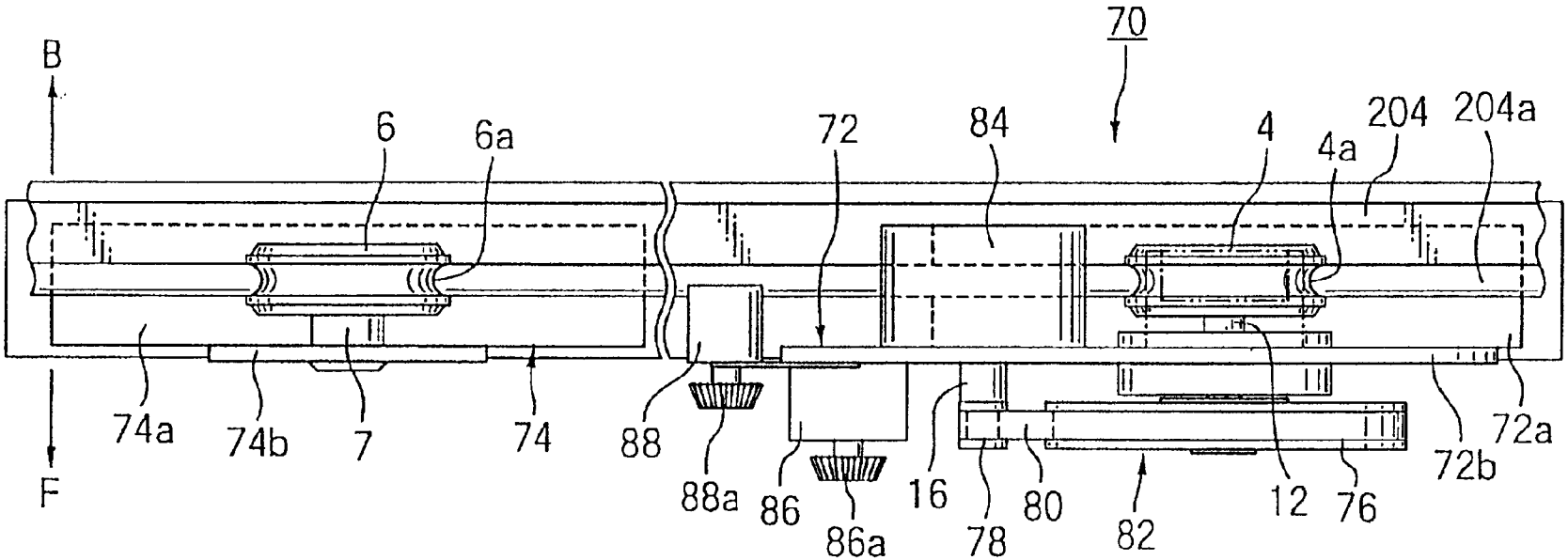
FIG. 9 is a view taken along a line IX—IX of FIG. 8; and is finally closed.
Figure 10:
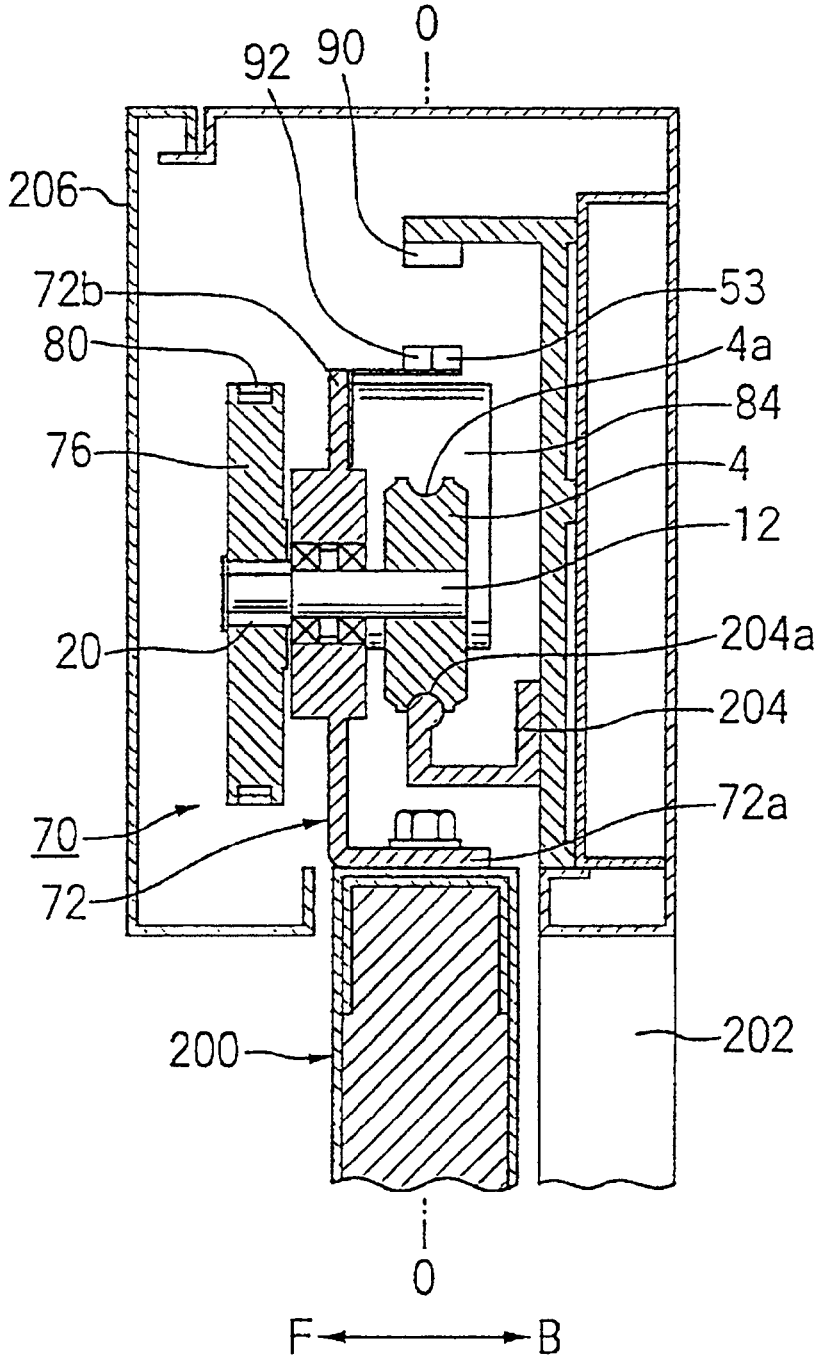
FIG. 10 is a cross-sectional view taken along a line X—X of FIG. 8.
Figure 11:
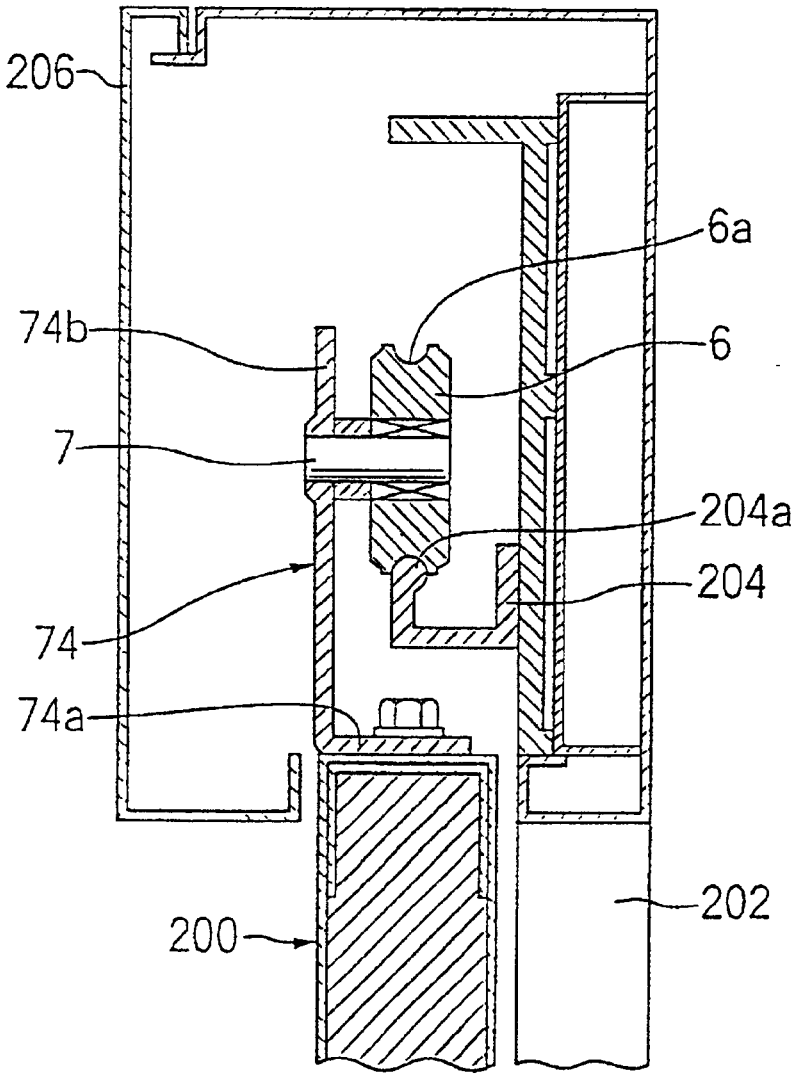
FIG. 11 is a cross-sectional view taken along a line XII—XII of FIG. 8.

As can be seen from FIGS. 9 and 10, each of mounting brackets 72, 74 is formed into a L-shaped cross-section. Each of the respective mounting brackets 72, 74 has a respective horizontal plate portion 72*a*, 74*a* to be attached to the top surface of the slide door 200. A vertical plate portion 72*b*, 74*b* which extends straight in a vertical and upward direction so as to be flush with the front surface of the slide door 200. Referring to FIG. 9, each of the door roller shafts 12 and 7 extends through the vertical plate portion 72*b*, 74*b* in perpendicular thereto and in horizontal therewith. A rear end portion of the shaft 12, 7 is located on the doorframe 202 side (the "B" side indicated by the arrow) with respect to the vertical plate portion 72*b*, 74*b*, and a front-end portion which is located on the opposite side of the door roller 4 with respect thereto. Each of the door rollers 4 and 6 is mounted on the rear end portion of the door roller shafts 12 or 7, respectively.

Referring to FIG. 10, a large diameter sprocket wheel 76 is mounted via a one-way bearing 20 on the front-end portion of the door roller shaft 12. Further, the door roller shaft 12 is mounted on the vertical plate portions 72*b* of the mounting bracket 72 via the one-way bearing. The one-way bearing 20 is similar to that shown in FIG. 2 in the respect that it transmits the rotation of the door roller 12 to the large diameter sprocket wheel 76 only while the slide door 200 travels from the opened position to the closed position.

Referring again to FIG. 9, a generator 84 is located adjacent to the door roller 4 on the same side of the vertical plate portion 72*b* of the mounting bracket 72. According to this arrangement, the door roller 6, the generator 84, the vertical plate portions 72*b* and 74*b* and the horizontal plate portions 72*a* and 74*a* form a "C" shape to define a space for ccommodating the rail 204 (hereinafter referred to as the ""C" ccommodating space"), as shown in FIG. 10. Further, as shown in FIGS. 9 and 10, the total height and the total depth of the speed regulator 70 are nearly equal to the respective height and depth of the door roller 4 which is a typical height and depth of a door roller for a suspension-type slide door. Thus, the speed regulator 70 is configured to be accommodated within a space defined by the doorframe 202, the rail 204, and a typical cover 206 enclosing the rail 204. As shown in FIGS. 10 and 11, in a vertical cross-sectional plane across the thickness of the slide door 200, a center line of the guide surface 204*a* of the rail 204 and the door rollers 4 and 6 are aligned with the center line O—O of the slide door 200.

The main body of the generator 84 is disposed on a back surface of the vertical plate portion 72*b* and the rotatable shaft 16 of the generator 84 is arranged perpendicular to the vertical plate portions 72*b* so as to extend therethrough in the horizontal direction. A small diameter sprocket wheel 78 having a smaller diameter than that of the large diameter sprocket wheel 76 is mounted on the rotatable shaft 16 at an end portion thereof. The rotation of the large diameter sprocket wheel 76 is transmitted via an endless toothed belt 80 to the small diameter sprocket wheel 78. Thus, mechanical movement transmission means 82 comprises the large diameter sprocket wheel 76, the small diameter sprocket wheel 78, and the endless toothed belt 80.

Regulating dials 86a and 88a for changing respective resistance values of variable rheostats 86 and 88 connected to the output of the generator 84 are attached to a front surface portion of the vertical plate portion 72*b*. Referring to FIG. 8, a switching member or a magnet 90 is mounted on a top portion of the doorframe 202 at a predetermined position which is apart a predetermined distance "d" from the closed potion toward he opened position. Further, proximity switches 53 and 92 which are activated by the magnet 90 are arranged on the top surface of the vertical plate portion 72*b* so as to oppose to the magnet 90.

Further, as shown in FIG. 8, a non-contact type infrared sensor 94 is mounted on the slide door 200 at an edge portion thereof which faces toward the passage side. On the other hand, a reflecting member 96 opposing to the infrared sensor 94 is mounted on the doorframe 202 so as to detect the person, the wheelchair, or the like which approaches the slide door 200.

The main body of a speed regulator 70 according to the fourth embodiment is mounted in the following manner. In the case where the slide door 200 is an existing one, at first, the door roller mounted on the top surface of the slide door 200 is removed. By merely attaching the mounting bracket 72 to the top surface of the slide door 200 by a screw, an attaching operation of the speed regulator 70 is completed. No mounting work is necessary for the rail 204. Then, the rail 204 is inserted into the "C" accommodating space, respective groove portions 4*a* and 6*a* on the outer surface of the respective door rollers 4 and 6 are engaged with the guide surface 204*a* of the rail 204 to mount the slide door 200 on the rail 204.

Figure 12:
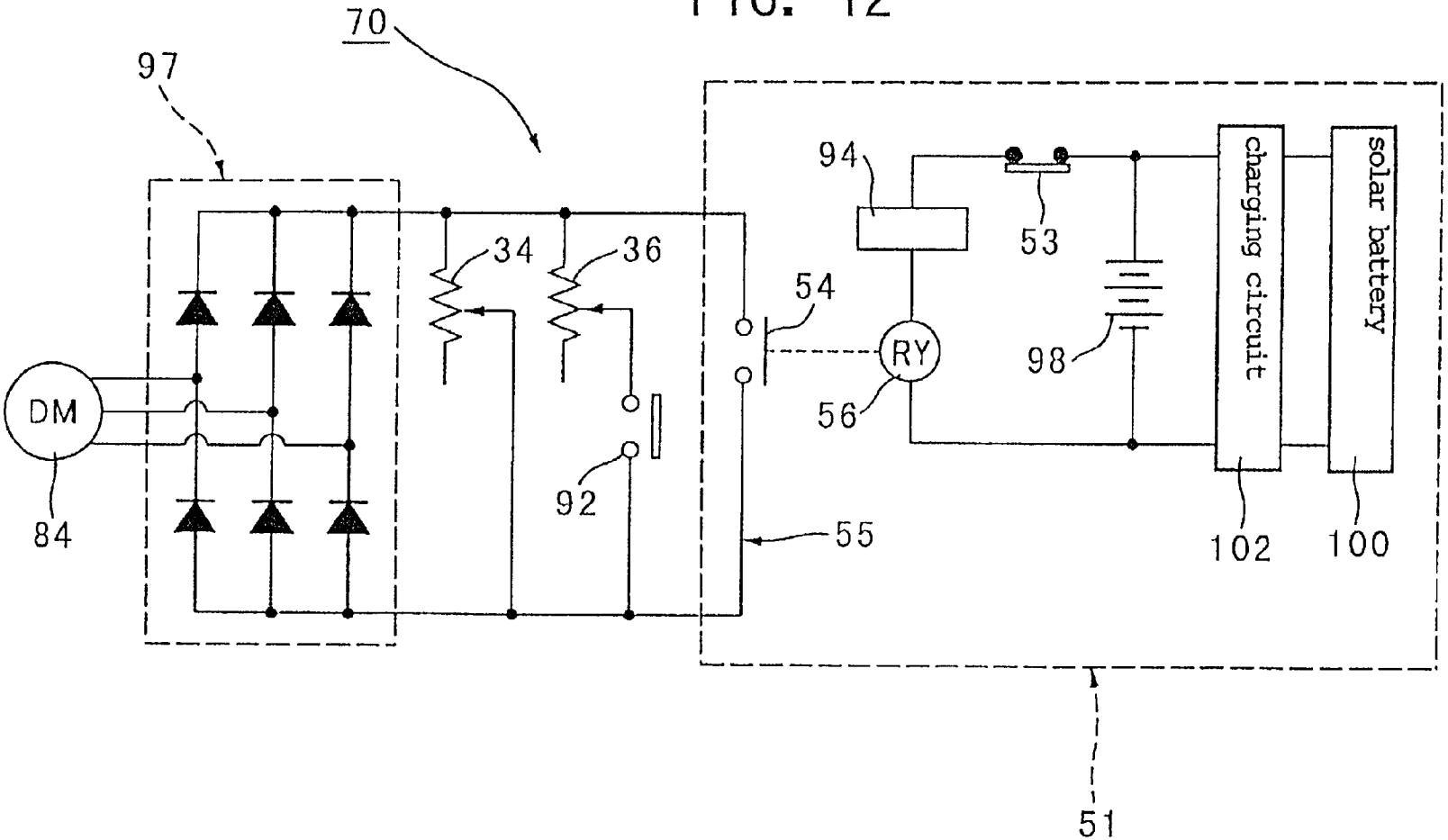
FIG. 12 is a circuit diagram according to the fourth embodiment of the present invention shown in FIGS. 8 to 11.

FIG. 12 is a circuit diagram according to the fourth embodiment shown in FIGS. 8 to 11.

The fourth embodiment shown in FIG. 12 is different from the third embodiment shown in FIG. 7 in the respect that (1) a generator 84 is a three phase AC generator having a rectifying circuit 97, (2) a charging battery 98, a solar battery 100, a charging circuit 102 for charging said charging battery 98 with current produced by the solar battery 100 are connected in parallel with the sensor 94 instead of the battery 58 in the sensor circuit 51, and a proximity switch 53 for breaking the sensor circuit 51 when the second closing speed is obtained in order to prevent the charging battery 98 to be consumed is installed to the sensor 94 in series, and (3) a limit switch or a proximity switch 92 is installed to a variable resistor 36 in series instead of the switches 38 and 39. Since both circuits according to the third and the fourth embodiments are similarly constructed except the points described above, their similar configurations shall be represented by the same reference numerals and no detailed description therefore shall be made.

In the fourth embodiment, the charging battery 98 is configured so as to be constantly charged by the solar battery 100 and the charging circuit 102 to eliminate the need of replacing the battery. Once the proximity switches 53 and 92 are operated, they are kept energized until the slide door reaches the closed position so as to maintain the second closing speed.

Figure 13:
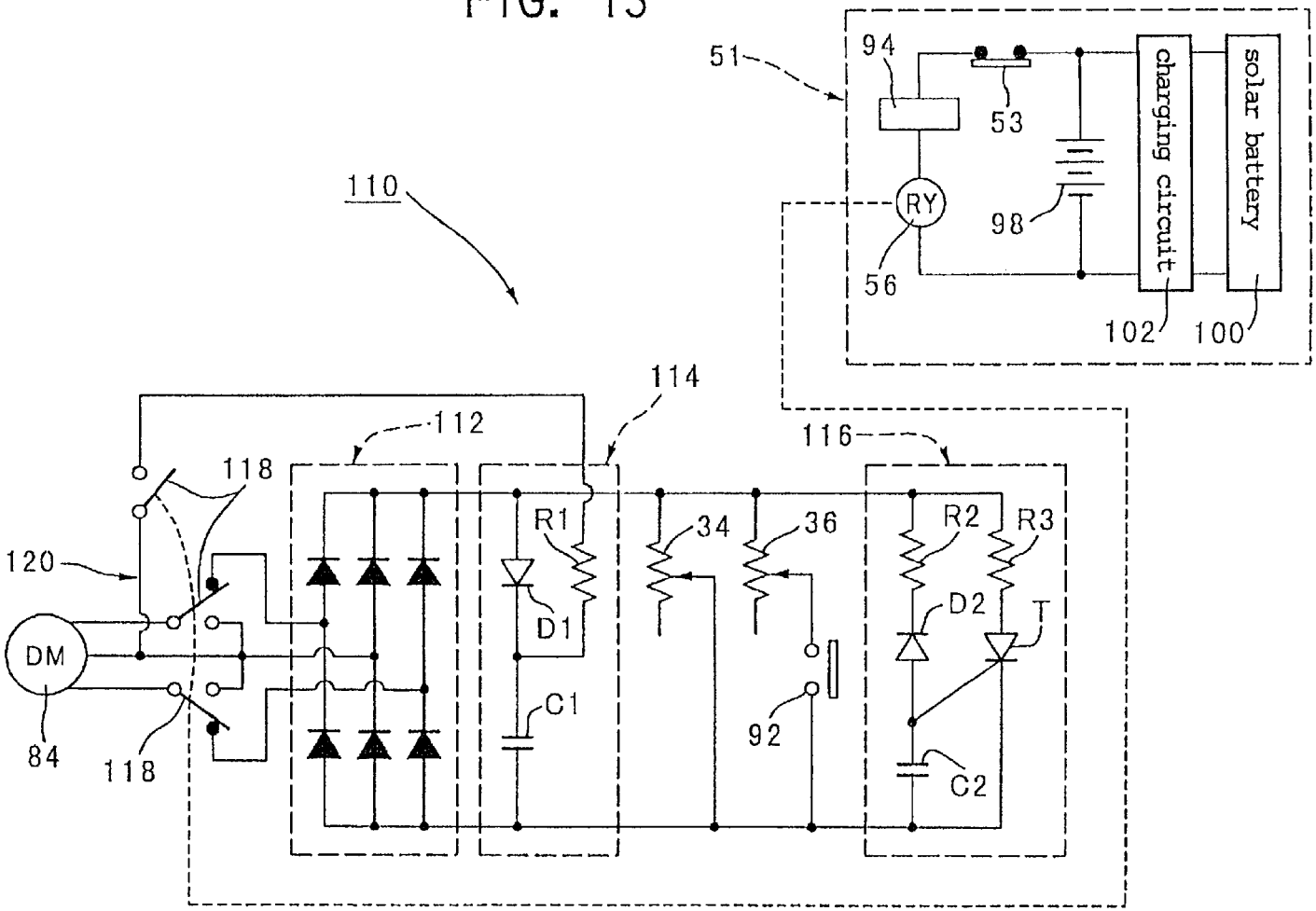
FIG. 13 is a circuit diagram of a speed regulator according to a fifth embodiment of the present invention.

FIG. 13 shows a circuit diagram of a speed regulator according to a fifth embodiment.

Since the speed regulator 110 according to the fifth embodiment is arranged in the same way as the speed regulator 70 in accordance with the fourth embodiment shown in FIGS. 8 to 11 in terms of a mechanical structure, the description thereof shall be omitted. The speed regulator 110 according to the fifth embodiment is different from that of the fourth embodiment shown in FIG. 12 in the respect that the regulator 110 does not have the short circuit 55 and instead thereof, a circuit 114 for assisting in stopping the slide door is provides in parallel with the output of the rectifying circuit 112 so as to completely stop the slide door 200 by discharging the charged electricity to the three phase AC generator 84 (hereinafter referred to as the "slide-door-stop assisting circuit"). Further, it is different in that the generator 84 is provided with a short circuit 120. Additionally, the speed regulator 110 according to the fifth embodiment is different from the fourth embodiment shown in FIG. 12 in the respect that, in the case of emergency where the slide door 200 is closed at a high speed by hand or where a force is suddenly applied to the slide door traveling at the first closing speed to close the slide door 200 at a high speed, the speed regulator 110 has a sudden-close preventing circuit 116 which forces to brake against the closing movement of the slide door 200 by applying sudden braking to the slide door 200 so that the slide door 200 is prevented from bumping a person passing by the door. Further, it still differs from the fourth embodiment in the respect that a relay contact point 118 is installed to the output of the generator 84 and is opened or closed by a relay 56 connected to a sensor 94 in series.

The slide-door-stop assisting circuit 114 produces a smooth DC voltage through a diode D1 and a capacitor C1. This voltage is applied to two outputs of a generator 84 via a resistor R1 and a normal open relay contact point 118.

Further, the sudden-close preventing circuit 116 has a combined set of a resistor R2, a Zener diode D2, and a capacitor C2 which are connected in series, and another combined set of a resistor R2 and a thyrister T (GTO) which are connected parallel with the former set, and the joint point between the Zener diode D2 and the capacitor C2 is further jointed to the gate of the thyriter T.

First, the operation of the slide-door-stop assisting circuit 114 shall be described. While the slide door is closing, the capacitor C1 is charged through diode D1 to a DC voltage. If the sensor 94 detects a person or the like, the relay 56 operates to close the normal open contact point of the relay contact point 118, and whereby the short-circuit 120 of the generator 84 is formed. Simultaneously, the charge at the capacitor C1 flows through the resistor R1 to the generator 84, and this strongly brakes the generator 84 and whereby the rotation thereof is suddenly stopped.

Secondly, how the sudden-close preventing circuit 116 operates shall be explained. If the generator 84 operates to generate a current and the voltage of the circuit 112 exceeds a breakdown voltage of the Zener 10 diode D2 due to the fast traveling speed of the slide door 200, the capacitor C2 is charged. The voltage of capacitor C2 is applied to the gate of the thyrister T. When the applied voltage exceeds a turn-on voltage of the thyrister T, the thyrister is connected so that a braking force is produced through resistor R3.

Figure 14:
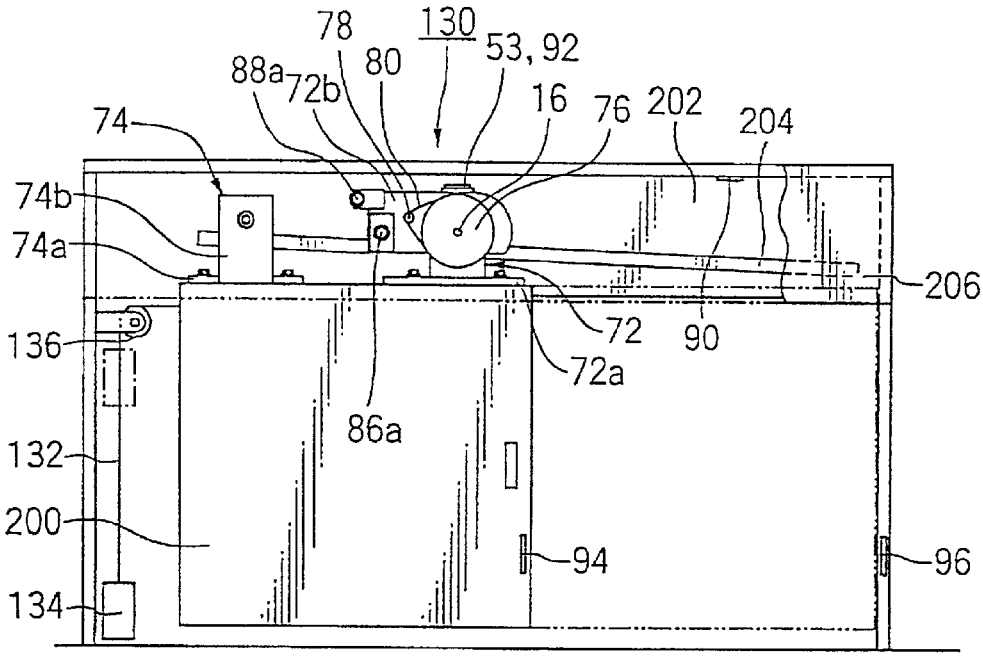
FIG. 14 shows a speed regulator according to a sixth embodiment of the present invention.

FIG. 14 shows a speed regulator according to a sixth embodiment.

The speed regulator according to the sixth embodiment shown in FIG. 14 is preferable to a very heavy slide door 200 which is as heavy as 500 kg to 1000 kg and is used in a warehouse or the like. The speed regulator 130 according to the sixth embodiment is similarly arranged as the speed regulator 70 according to the fourth embodiment shown in FIGS. 8 to 11, except in that a balance weight 134 is installed so as to give a force in the direction for opening the slide door 200. Therefore, the same components are indicated at the same reference numerals and no detailed description therefore shall be made. Only the different points shall be described below.

The speed regulator 130 according to the sixth embodiment has a cable 132 whose upper end is connected to one side of the slide door 200 at an upper edge opposite to the passage side thereof. A balance weight 134 is coupled to a lower end of the cable 132 and a pulley 136 mounted on the side of the doorframe 202 at an upper end thereof opposite to the passage side of the opened slide door for guiding the cable 132. The balance weight 134 is at its upper position as shown in a dotted line when the slide door 200 is at the closed position and is at its lower position as shown in a solid line when the slide door 200 is at the opened position. Since the rail 204 extends obliquely downward in the direction to close the slide door 200, the slide door 200 tends to close due to its own weight. The force by the weight of the balance weight 134 is set to be smaller than the closing force described above.

In the sixth embodiment, the slide door can be opened when a force slightly larger than the difference between the closing force due to the own weight and the force exerted by the balance weight. On the other hand, when the hand is withdrawn from the slide door, the slide door 200 travels along the rail 204 and is automatically closes due to the difference between the forces described above. While it is closing, the speed regulator 130 reduces the closing speed.

In the speed regulator according to the first embodiment to the sixth embodiment, since the main body is constructed as a unit, the speed regulator can be easily mounted on the slide door 200. It requires to merely mount the regulator of the present invention by attaching the mounting brackets 8 and 72 to the top surface of the slide door 200. Further, since the generator 15 or 84 is employed, no wiring is necessary and this speed regulator can be utilized even if no power supply is provided nearby. Further, neither the work for mounting the rail 204 nor the construction work for the building is required. Therefore, when the mounting work is implemented, after removing the slide door 200 and carrying it outdoors, no noise or dust may be caused on the site. Accordingly, this speed regulator is most suitable to the slide door being actually used, for example, at hospitals or the like.

In the speed regulator according to the first to the sixth embodiments, since the slide door 200 is of suspension type, no rail is required on the floor. Therefore, the floor can be made free of barrier. Therefore, the speed regulator is most suitable to the hospitals where wheelchairs or the like are used.

In the speed regulator according to the first to the fifth embodiments, the height and depth thereof are dimensioned so that the regulator can be accommodated within the existing space defined by the doorframe 202, the rail 204, and the cover 206. Therefore, the speed regulator can be mounted on the existing slide door 200 without any construction work in the building.

Further, in the speed regulator according to the first to the sixth embodiments, when the slide door 200 is opened, the one-way bearing 20 prevents the rotation of the door roller 4 to be transmitted to the generator 15 or 84. Accordingly, the door roller 4 is not subjected to the braking force from the generator 15 or 84 and the slide door can be opened with a small force. On the other hand, when the slide door 200 is closed, the rotation of the door roller 4 is suppressed by the generator 15 or 84. Accordingly, the closing speed of slide door is reduced. Thus, it can eliminate a situation where the slide door 200 gives a fear to a person passing by the slide door for the reason that the door may bump him.

Further, in the speed regulator according to the first to the sixth embodiments, since the resistance value, of the variable resistor 26, 34, or 36 is adjustable, the closing speed of the slide door 200 can be set to the most suitable one to the people who frequently pass thereby. This ensures to eliminate the situation where the slide door gives fear to a person passing by the slide door or causes to bump to him. By changing the resistance value through the adjusting dial 24*a*, 32*a*, 86*a*, or 88*a*, the closing speed of the slide door can be changed, for,example, at hospitals, corresponding to a appropriate walking speed of a hospitalized patient using the room. It can be adjusted every time a patient is accommodated. In addition, if the weight of the slide door and the slope angle of the existing rail 204 change, the resistance value can be adjusted at the site after installing the speed regulator so that the slide door 200 may be closed at a desired speed. The requirement for the resistor 36 is only to have a smaller resistance value than that of the resistor 34. The resistor 36 may be replaced by a short circuit.

Further, in the speed regulator according to the second to the sixth embodiments, since the closing speed of the slide door 200 is further reduced due to the switching from the variable resistor 34 to the variable resistor 36 when the slide door has reached the point which is distant by "d" from the closed position of the slide door 200, the finger clamping can be prevented and the noise is also prevented when the slide door 200 is closed completely.

Further, in the speed regulator according to the third to the sixth embodiments, since the sensor 52 or 94 detects that a person or the like is coming near to the closing slide door 200 and the slide door is nearly stopped in the third embodiment) or completely stopped in the fourth and fifth embodiments. Therefore, it is possible to prevent the slide door 200 from bumping into a person or the like.

Further, in the speed regulator according to the third, fourth and sixth embodiments, when the sensor 52 detects a person or the like, the short circuit 55 works so that the slide door is decelerated to be more or less stopped. The door roller 4 or 6, however, is still slightly rotating, and if the person or the like goes out of the detection area of the sensor 52, the slide door 200 can smoothly be accelerated to its original first predetermined speed.

Further, in the speed regulator according to the fourth and sixth embodiments, since the main body of the speed regulator is constructed as a unit and mounting the speed regulator can easily be finished within a short period of time only by attaching the mounting bracket 72 to the top surface of the slide door. Further, since the slide door 200 can be mounted on the existing rail only by inserting the existing rail into the "C" accommodating space for the speed regulator, no work is required for the rail and neither dust nor noise is produced on the site.

Further, in the speed regulator according to the fourth embodiment, since the sensor 52 uses the charging battery 98 to be charged by the solar battery 100, the battery need not be replaced. Since it is constantly charged, constant operation of sensor 52 is ensured. Further, since a magnet turns off the proximity switch 53 when the slide door 200 reaches the predetermined position which is apart the distance "d" from the closed position of the slide door 200, the sensor turns inactive to prevent the consumption of the battery 98.

Further, in the speed regulator according to the fifth embodiment, since the slide-door-stop assisting circuit 114 is provided, the slide door 200 can be completely stopped within a short period.

Further, in the speed regulator according to the fifth embodiment, since the sudden-close preventing circuit 116 is provided, the slide door 200 can be prevented from bumping to a person passing by the slide door even if another person is trying to quickly close the slide door 200 by hand or the slide door 200 is closing at a speed much higher than the predetermined one for some reason.

In the speed regulator according to the sixth embodiment, though the self-weight of the slide door 200 serves as a large force for closing the door because the rail 204 extends obliquely in a downward direction toward the, closed position of the slide door 200. The slide door 200 can be opened with a small force, even if the slide door is heavy, because the force of the balance weight 134 acts in the opposite direction of the closing force described above.

Many changes and modifications can be made to the present invention without departing from the spirit and the scope of claims described in the claims of the present invention, and, of course, these changes and modifications are included in the claims.

For example, in the first to the sixth embodiments, the descriptions have been made for the suspension type speed regulator mounted on the automatically closing slide door 200 which travels along the rail 204. The slide door 200, however, may be any type of automatically closing slide door, for example, such as the one suspended on a horizontally-extending rail, the one supported on a rail laid on the floor, or the like. Further, the slide door may be pulled by a weight, may be closed by such biasing means as a spring, a damper or the like, or may be closed at a constant speed. Further, the door roller may be installed on the lower portion of the slide door, rather than on the upper portion of the slide door.

Further, the door roller 4 in the first to the sixth embodiments is not necessarily an indispensable component and the existing door roller mounted on the slide door may be utilized. When the existing door roller is used, what is necessary to do is only to operatively couple the door roller 4 to the generator so that the rotation of the door roller 4 may be transmitted to the rotatable shaft 16 of the generator 15 or 84. The mounting bracket of the door roller 4 may be separated from the mounting bracket 8 or 72 of the main body of the speed regulator.

Further, in the first to the sixth embodiments, the rotatable shaft 16 of the generator is driven through the rotation of the door roller shaft 12 of the door roller 4, which is transmitted through a gear train of the gear 14 and 18, the sprocket wheel 76, 78 and the endless belt 80. The rotatable shaft 16 of the generator, however, may be driven by any mechanically moving or mechanically rotating transmission means in which the linear movement of the slide door 200 may be converted into the rotational movement and then transmitted.

Further, the one-way bearing 20 in the first to the sixth embodiments may be any selective coupling means in which the rotation of the door roller shaft 12 can be transmitted to the rotatable shaft 16 of the generator 15 only when the slide door 200 is closing.

Further, the generator 15 or 84 in the first to the sixth embodiments may be any type of motor working as a generator such as a DC motor, a dynamo, single phase AC motor or three phase AC motor or the like. When an AC motor is used as the generator 15, for example, the rectifying circuit can be connected as shown in FIGS. 12 and 13.

Further, the variable resistor 26, 34, or 36 in the first to the sixth embodiments may be a fixed resistor. When a fixed resistor is used, the resistance value thereof may be determined so that the slide door 200 closes at a desired closing speed. Using a fixed resistor is more inexpensive than using a variable resistor.

Further, in the second to the sixth embodiments, a 2-speed reduction mechanism is employed in which the speed can be switched to two closing speeds. Alternatively, for example, a multi-speed reduction mechanism corresponding to a plurality of closing speeds, may be employed in which a plurality of resistors whose resistance values get smaller in sequence are installed and a plurality of corresponding switches or proximity switches are installed on the doorframe 202.

Further, though the switch 40 in the second to the sixth embodiments is placed in the vicinity of the closed position of the slide door 200, the switch 40 may be placed at any position, if necessary, where switching of the closing speed is desired.

Further, in the second to the sixth embodiments, the switching means placed in the vicinity of the closed position of the slide door may comprise a micro switch and means for pressing the micro switch.

Further, though the sensor 52 in the third to the sixth embodiments is of non-contact type, a contact type sensor may be employed so long as the sensor detects a person or the like to activate the sensor circuit 51 and deactivates it automatically when the person leaves.

Further, for example, two rheostats may be connected to the output of the generator 15 or 84 in series, with a micro switch connected parallel with one of the two rheostats, which is pressed to make a short circuit for said one of the two rheostats.

Further, the sudden-close preventing circuit 116 according to the fifth embodiment may be installed parallel with the circuit of the first to the fourth, embodiments.

Further, the weight of the balance weight 134 in the speed regulator 130 according to the sixth embodiment may properly determined to produce a force which is smaller than that for making the slide door 200 open and also provides a desirable force for opening the slide door 200.

Further, though the speed regulator 130 according to the sixth embodiment has a balance weight.134, the means for giving the force in the reverse direction of closing the slide door 200 does not necessarily have to be a weight. Any other counterbalance means such one as a spring, a damper, etc. may be employed, or further rotating means for giving the door roller 4 or 6 a rotational force in the.direction to open the slide door may be employed.

Further, though the cable 132 in the speed regulator 130 according to the sixth embodiment is coupled to the slide door 200 so that the force of the balance weight 134 acts on the slide door 200, the force by this counterbalance means may act on the speed regulator.

Industrial Applicability

As described above, a speed regulator for an automatically closing slide door according to the present invention allows the closing speed of the door to be reduced so that the door is closed at the most preferable speed for a person passing the slide door, and the present invention can provide a speed regulator for an automatically closing slide door which does not cause such problems of the bump to the slide door, the finger clamping, the closing noise.

What is claimed is:

1.A speed regulator for regulating a closing speed of an automatically closing slide door having a door roller, the closing speed of the slide door being regulated after the slide door has been manually opened, said speed regulator comprising:

a generator activated by a rotation of said door roller for suppressing a rotational speed of said door roller;

one-way clutch means for preventing transmission of, while said slide door is opening, and transmitting, while said slide door is closing, the rotation of the door roller to said generator;

a resistor connected to an output of said generator; and speed change means for changing a closing speed of said slide door, at a predetermined position before a closed position of said slide door, from a first predetermined speed to a second predetermined speed which is slower than said first predetermined speed by changing a resistance value of said resistor.

2. A speed regulator for regulating a closing speed of an automatically closing slide door having a door roller, the closing speed of the slide door being regulated after the slide door has been manually opened, said speed regulator comprising:

a generator activated by a rotation of said door roller for suppressing a rotational speed of said door roller;

one-way clutch means for preventing transmission of, while said slide door is opening, and transmitting, while said slide door is closing, the rotation of the door roller to said generator;

a resistor connected to an output of said generator, said resistor having a first resistor and a second resistor, the resistance value of said second resistor being smaller than that of said first resistor; and speed change means for changing a closing speed of said slide door, at a predetermined position before a closed position of said slide door, from a first predetermined speed to a second predetermined speed which is slower than that said first predetermined speed, said speed change means having switching means between said first resistor and said second resistor to change said resistance value of said resistor.

3. A speed regulator for regulating a closing speed of an automatically closing slide door having a door roller, the closing speed of the slide door being regulated after the slide door has been manually opened, said speed regulator comprising:

a generator activated by a rotation of said door roller for suppressing a rotational speed of said door roller;

one-way clutch means for preventing transmission of, while said slide door is opening, and transmitting, while said slide door is closing, the rotation of the door roller to said generator;

a resistor connected to an output of said generator, said resistor having a first resistor and a second resistor, the resistance value of said second resistor being smaller than that of said first resistor; and speed change means for changing a closing speed of said slide door, at a predetermined position before a closed position of said slide door, from a first predetermined speed to a second predetermined speed which is slower than said first predetermined speed, said speed change means having switching means between said first resistor and said second resistor to change said resistance value of said resistor, at least one of said first and said second resistors being a variable resistor.

4. A speed regulator in accordance with any one of claims 1 to 3, further comprising:

sensor means for detecting a person or an object while said slide door is closing; and slide door stop means for substantially stopping said slide door when said sensor means detects the person or the object.

5. A speed regulator in accordance with claim 4, wherein:

said slide door stop means comprises a short circuit which allows the output of said generator to pass when said sensor means detects the person or the object.

6. A speed regulator in accordance with any one of claims 1 to 3, further comprising:

sudden close preventing means for a slide door, which forcibly brakes the closing movement of said slide door when the closing speed of said slide door exceeds a predetermined value.

7. A speed regulator in accordance with any one of claims 1 to 3, wherein:

said slide door is suspended from a rail via a door roller;

said generator, said one-way clutch means and said resistor are combined into a unit; and said unit is mounted on said slide door by a: bracket.

8. A speed regulator in accordance with claim 7, further comprising:

speed increasing means for increasing a rotational speed of said door roller so as to transmit an increased rotation speed to said generator.

9. A speed regulator for regulating a closing speed of an automatically closing slide door having a door roller which rotates along a rail, the closing speed of the slide door being regulated after the slide door has been manually opened, said speed regulator comprising:

a generator activated by a rotation of said door roller for suppressing a rotational speed of said door roller;

one-way clutch means for preventing transmission of, while said slide door is opening, and transmitting, while said slide door is closing, the rotation of the door roller to said generator; and a resistor which is connected to an output of said generator and has a resistance value capable of reducing a closing speed of said slide door to a first predetermined speed.

10. A speed regulator in accordance with any one of claims 1, 2, 3, and 9, wherein:

said slide door is suspended via a door roller from a rail extending obliquely downward in a direction of closing the slide door so that side door closes due to its own weight, and further comprises counterbalance means for giving a force in the direction to open said slide door so as to reduce the pulling force required for opening said door.

* * * * *